United States Patent [19]

Deabriges et al.

[11] 4,273,863

[45] Jun. 16, 1981

[54] PROCESS OF FORMATION OF COLOR IMAGES, PHOTOGRAPHIC PRODUCT AND TREATING SOLUTIONS USEFUL FOR PUTTING THE PROCESS INTO PRACTICE

[75] Inventors: Jean Deabriges, Aix-En-Province; Yves Ferré, Le Perreux-Sur-Marne; Claude Goumont, Chelles, all of France

[73] Assignee: Eastman Kodak Company, Rochester, N.J.

[21] Appl. No.: 61,773

[22] Filed: Jul. 27, 1979

Related U.S. Application Data

[62] Division of Ser. No. 837,778, Sep. 29, 1977, Pat. No. 4,186,004.

[51] Int. Cl.[3] ..... G03C 7/00; G03C 5/30

[52] U.S. Cl. ..... 430/467; 430/469; 430/483; 430/486; 430/487

[58] Field of Search ..... 430/467, 483, 218, 223, 430/239, 242, 462, 469, 486, 487, 488, 490, 491, 492; 252/62.1, 192, 193; 260/583 R; 562/512, 553

[56] References Cited

U.S. PATENT DOCUMENTS

| | | | |
|---|---|---|---|
| 767,815 | 8/1904 | Homolka et al. | 430/486 |
| 2,191,037 | 2/1940 | Mannes et al. | 430/469 |
| 2,311,428 | 2/1943 | Wood | 430/486 |
| 2,657,138 | 10/1953 | Robbins | 430/487 |
| 2,840,471 | 6/1958 | Berry | 430/486 |
| 3,477,849 | 11/1969 | Becker | 430/215 |
| 3,938,997 | 2/1976 | Fisch et al. | 430/466 |
| 3,960,569 | 6/1976 | Ono | 430/218 |
| 3,982,945 | 9/1976 | Willems | 430/487 |
| 4,147,543 | 4/1979 | Kubotera et al. | 430/486 |
| 4,170,478 | 10/1979 | Case et al. | 430/467 |

*Primary Examiner*—Richard L. Schilling
*Attorney, Agent, or Firm*—Arthur H. Rosenstein

[57] ABSTRACT

A process of forming color images comprises imagewise exposing a silver halide photographic color image-transfer product comprising an image dye-providing compound in the presence of a silver halide developer, and treating the exposed photographic product with an alkaline processing composition in the presence of an amino acid or a combination of an acid and an amine. Color images are achieved having excellent image discrimination (Dmax-Dmin).

6 Claims, No Drawings

PROCESS OF FORMATION OF COLOR IMAGES, PHOTOGRAPHIC PRODUCT AND TREATING SOLUTIONS USEFUL FOR PUTTING THE PROCESS INTO PRACTICE

This is a division of application Ser. No. 837,778, filed Sept. 29, 1977, now U.S. Pat. No. 4,186,004.

The present invention relates to color photography, and more particularly to a process of formation of color images and to a photographic color imagetransfer product whose sensitometric characteristics are improved in comparison with those of the photographic products of the prior art. The present invention also relates to an activator and an alkaline developer composition useful for treating the exposed photographic product. The process according to the invention employs a photographic product which comprises one or more elements, containing one or more light-sensitive imaging layers, each light-sensitive imaging layer having associated therewith a nondiffusible image dye-providing compound which, as a function of the development of the exposed silver halides, liberates a diffusible dye or dye precursor, so that a residual nondiffusible image of a colored compound, as well as a transferred image of a colored compound, is obtained.

Numerous processes exist for the formation of color images. Photographic color image-transfer products of the prior art, which give images in color, comprise, for example, one or more photosensitive silver halide layers and an image dye-forming compound such as a photographic coupler being associated with each silver halide layer. After exposure and development, a dye image whose color is complementary to the light absorbed by the associated light-sensitive layer is produced.

Other processes of formation of color images exist which use, in place of photographic couplers, other image dye-providing compounds that contain a ballast group which renders them nondiffusible in the layers of the photographic products where they are incorporated. After exposure, and as a function of the development, the image dye-providing compound liberates a diffusible dye in the course of the treatment so that a residual image of colored compound is obtained, as well as a release image which can be captured by a receiver.

A process of this type is described, for example, in U.S. Pat. No. 4,076,529 issued Feb. 28, 1978, where a photographic product is used which comprises at least one image dye-providing element comprising at least one layer of photosensitive silver halide emulsion with which is associated a nondiffusible image dye-providing substance which comprises a sulfonamidophenol or sulfonamidoaniline group and a dye or dye-precursor group. After exposure according to an image, the photographic product is treated with an alkaline processing composition in the presence of a silver halide developing agent in such a way that, in each dye image-forming element, a silver image is developed and a distribution is formed, according to an image, of oxidized developer which crossoxidizes the molecule of the image dye-providing substance to a quinonoid species which now, in an alkaline medium, cleaves to liberate a diffusible dye or dye precursor, as a function of the exposure received by each of the photosensitive silver halide layers. The diffusible dye image formed in each image-forming element are eliminated, either by causing them to migrate by diffusion into the treatment bath or by transferring them onto a layer containing a mordant. In addition, a residual image of colored substance is obtained in the initially photosensitive element. If the photosensitive silver halide emulsions of the photographic product are negative emulsions (that is, emulsions which give negative silver images after exposure to a positive original), the image remaining in the photographic product is a positive color image with respect to the original. The photographic product which carries this positive color image also comprises a negative silver image and a distribution of unexposed and undeveloped silver halide. If it is desired to keep only the positive color image, it is necessary to eliminate the residual silver halides and the developed silver image by known processes, for example, by treatment in a bleaching bath, followed by a treatment with a fixing bath, or by a treatment in a bleaching-fixing bath, such as described in U.S. Pat. No. 3,923,510.

The dye images obtained as described in the preceding paragraph do not, in all cases, have satisfactory sensitometric characteristics; in particular, the minimum densities are often too high. In the prior-art technique of keeping the nontransferred image (better known as retained image), the residual dye is generally bleached to obtain a satisfactory Dmin.

The present invention contributes a solution to this problem and has particularly as its objects:

(1) a process for obtaining improved image discrimination in both retained and transferred dye images;

(2) a process for forming an image of colored compounds, positive or negative with respect to the original, from image dye-providing compounds containing sulfonamidophenol or sulfonamidoaniline groups, the image formed showing improved sensitometric characteristics, in particular, low minimum densities of the retained image and satisfactory maximum densities of transferred images;

(3) in processes such as described in U.S. Pat. No. 3,923,510 wherein a retained image is used and the released dyes are discarded, the improvement wherein no dye bleach step is required;

(4) a photographic product comprising at least one photosensitive silver halide element, useful for carrying out the process according to the invention; and (5) an alkaline processing composition likewise useful for carrying out the process according to the invention.

The process according to the invention comprises (1) imagewise-exposing a photosensitive color image-transfer element comprising a support having thereon at least one photosensitive silver halide emulsion layer, said silver halide emulsion layer having associated therewith a dye image-providing material. Preferred dye image-providing materials correspond to the following formula:

$$\text{BALL-CAR-NHSO}_2\text{-COL}$$

wherein COL is any color-providing moiety such as a dye or dye-precursor moiety as described in U.S. Pat. No. 4,076,529 issued Feb. 28, 1978, BALL is an organic ballasting group which renders the compound nondiffusible in a photographic element during processing of said element with an alkaline composition, and CAR is any carrier moiety which is oxidizable, the oxidized form of which cleaves off from the $NHSO_2$ linkage; and (2) treating the photosensitive element with an alkaline processing composition in the presence of a silver halide developing agent and one or more compounds selected from the group consisting of aliphatic amino acids and a mixture of compounds containing at least one aliphatic carboxylic acid and compounds containing at least one aliphatic primary amine.

In a preferred process, the image dye-providing materials correspond to the formula above wherein CAR is a phenol such as naphthol and having the formula:

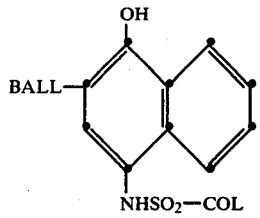

said process comprising (1) imagewise-exposing a photographic element comprising at least one layer of silver halide being associated with at least one image dye-providing compound and a receiver layer containing a mordant layer to accept the transferred image and (2) treating the exposed photographic product with an alkaline processing composition in the presence of a silver halide developer so as to form a silver image and the oxidation products of the developer which oxidize the molecule of the image dye-providing compounds, the oxidation product of which undergoes an hydrolysis reaction, liberating a diffusible dye as a function of the exposure received by each photosensitive element. The process is characterized in that the alkaline processing treatment is carried out in the presence of a combination of one or more compounds containing at least one aliphatic carboxylic acid and at least one aliphatic primary amine or in the presence of an aliphatic amino acid, which facilitates the elimination of the dye liberated and makes it possible to obtain an image of the colored compound both retained in the original element and a reverse image transferred to a receiver with improved image discrimination.

The process according to the invention for forming a retained image of colored compounds, positive with respect to the original, which colored compounds can correspond to the above formula, comprises:

(1) imagewise-exposing a photographic product which comprises a film unit containing at least one element containing at least one layer of silver halide negative emulsion with which is associated an image dye-providing compound corresponding to the formula above.

(2) treating the exposed photographic product with an alkaline processing composition in the presence of a silver halide developer so as to form a silver image, negative with respect to the original, thereby forming oxidation products of the developer which oxidize the molecule of the image dye-providing compound, which is then cleaved in the presence of the alkaline processing composition, thus liberating a diffusible dye as a function of the exposure received by each photosensitive element, (3) eliminating the liberated dye by diffusion into an alkaline solution or by mordanting on a strippable element, thus forming in the retained photographic product a residual image of colored compound, corresponding to the regions not exposed, i.e., an image positive with respect to the original, and (4) stripping the strippable element from the retained product and preferably treating the photographic product with a bleaching and fixing bath to remove the residual silver halides and the developed silver image. This process is characterized in that the treatment (2) is carried out in the presence of either an aliphatic amino acid or a mixture of compounds, one or more of which is an aliphatic carboxylic acid and one or more of which is an aliphatic primary amine.

In an alternative process, the above released colored compounds are mordanted in a receiving layer and the receiving layer can be stripped from the unit to reveal a transferred image or, using a format such as described in U.S. Pat. No. 4,076,529 issued Feb. 28, 1978, the unit can be integral and the released image can be viewed from the side opposite that which is exposed without stripping.

It is advantageous to use a straight-chain aliphatic ω-amino acid for carrying out the process according to the invention, and preferably an ω-amino acid soluble in water or basic solutions. Examples of useful amino acids comprise the aminocarboxylic acids such as 2-aminoacetic acid (glycine or glycocoll), 4-aminobutyric acid, 6-aminohexanoic acid, 11-aminoundecanoic acid, 12-aminododecanoic acid, etc., and aminosulfonic acids such as 2-aminoethylsulfonic acid and 10-aminodecanesulfonic acid. Mixtures or combinations of acids and amines may also be used, advantageously acids and amines soluble in water or basic solutions. We may, for example, use combinations of alkyl amines containing up to 5 carbon atoms such as n-butylamine, propylenediamine, and other amines and aliphatic carboxylic acids such as butyric acid, hexanoic acid or other acids, preferably in stoichiometric proportions, although mixtures containing from about 33% to about 66% by mole of the amine are useful.

To carry out the process according to the invention, the amino acid or the mixture of acid and amine may be introduced (a) into the alkaline processing solution used in stage (2) of the process according to the invention or (b) into at least one of the layers of the photographic product.

When the amino acid or the acid plus the amine are used in the alkaline processing composition of stage (2), said composition may contain the amino acid or the mixture of acid and amine in various concentrations, for example, at a concentration of about 0.1 g./l. to 60 g./l., and preferably at a concentration of about 1 g./l. to 20 g./l.

When the amino acid or the mixture of acid and amine are used in the photographic product, the content of amino acid or of the mixture in the photographic product may vary considerably, for example, from about 1 mg./dm.$^2$ to 20 mg./dm.$^2$, and preferably from about 5 mg./dm.$^2$ to 12 mg./dm$^2$.

Image dye-forming compounds corresponding to the formula above, useful in the photographic products used by the process according to the invention, are described, for example, in U.S. Pat. No. 4,076,529 issued Feb. 28, 1978.

According to a particular method of carrying out the invention, the process of formation of a retained color image according to the invention uses a photographic product which comprises a layer of photosensitive silver halide emulsion having associated therewith an image dye-providing compound (yellow, magenta or cyan) and a silver halide developer of the class of the 3-pyrazolidones.

After imagewise exposure, the photographic product is treated by the following solutions A and B.

A—alkaline processing composition comprising the amino acid or the mixture of acid and amine;

B—bleaching-fixing bath which comprises, in particular, at least one silver oxidizing agent such as the monosodium salt of the ferric complex of ethylenediaminetetraacetic acid and at least one silver halide complexing agent such as a thiocyanate or a thiosulfate of an alkali metal or of an ammonium ion.

Stage A may be carried out by impregnating the exposed photographic product with the alkaline processing composition, then applying on the photographic product a sheet of paper carrying a layer of mordant. The durations of treatments A and B are usually comprised of between 5 seconds and 10 minutes and preferably between 20 seconds and 5 minutes.

During treatment A, the alkaline processing composition brings about the silver image, in the exposed regions, by the development of the silver halides. The corresponding oxidation products of the developer crossoxidize the image dye-providing compound to a quinoneimide which is then hydrolyzed in a basic medium with liberation of a diffusible dye. The dye can then be mordanted on the mordant layer of the support applied against the photographic product to produce a transferred image.

During treatment B, the negative silver image can be bleached and the silver halides of the unexposed regions are complexed and dissolved.

According to another method, the process of carrying out the invention employs a photographic product which comprises, applied on a support, three dye image-forming combinations, each combination comprising, in particular, a layer of photosensitive silver halide emulsion associated with an image dye-providing compound, respectively cyan, magenta and yellow, and a silver halide developer of the class of the 3-pyrazolidones. After exposure, the photographic product is treated with the two treatment solutions A and B as described above.

According to another method of carrying out the invention, a photographic product with three dye image-forming elements such as described above is used, but treatments A and B are carried out in a tray, using an alkaline processing composition A which comprises a basic solution of amino acid or mixture of acid and amine, and a bleaching-fixing bath B such as described above.

According to another advantageous method of carrying out the invention, the process of formation of color images according to the invention employs a photographic product of several layers, which comprises the following structure:

| | |
|---|---|
| | protective overlayer of gelatin |
| layer sensitive to blue | negative silver halide emulsion + yellow image dye-providing compound + developer |
| interlayer | optional colloidal dispersion of Carey-Lea silver + ballasted scavenger for oxidized developer |
| layer sensitive to green | negative silver halide emulsion + magenta image dye-providing compound + developer |
| interlayer | dispersion of ballasted scavenger for oxidized developer |
| layer sensitive to red | negative silver halide emulsion + blue-green image dye-providing compound + developer |
| | transparent support |

In the above structure, it is preferred that the image dye-providing compounds selected contain a shifted dye precursor moiety.

After exposure according to an image, the photographic product is treated by one of the preceding treatment sequences in which an amino acid or a mixture of acid and amine are used in the alkaline processing composition.

The silver halide developers particularly useful in the photographic products with multiple layers such as the preceding structure comprise developers of the class of the 3-pyrazolidones, such as 1-phenyl-3-pyrazolidone, 4,4-dimethyl-1-phenyl-3-pyrazolidone, 4-hydroxymethyl-4-methyl-1-phenyl-3-pyrazolidone, etc.

Scavengers for oxidized developer particularly useful in the photographic products with multiple layers comprise hydroquinones with a ballast group such as defined in U.S. Pat. No. 3,700,253. Examples are 2,5-dialkylhydroquinones such as 2,5-dioctylhydroquinone, 2,5-didodecylhydroquinone, etc.

The process according to the invention can be carried out using either negative silver halide emulsions or direct-positive or reversal silver halide emulsions, and the processing can preferably be carried out at high pH such as 13–14 or at a lower pH such as 10–12, and the unit can be either peel-apart or integral.

The term "in association with" as used herein is meant to include the materials being in the same or contiguous layers so that the materials have access to each other.

In another embodiment according to this invention, the film units can be integral imaging-receiver color diffusion transfer film units in which the timing layers can be employed on a cover sheet, as disclosed in Canadian Pat. No. 928,559. In this embodiment, the support for the photosensitive element is transparent and is coated with the image-receiving layer, optionally an opaque light-reflective layer, a black opaque layer and photosensitive layers having associated therewith dye image-providing materials. A rupturable container containing the alkaline processing composition and optionally an opacifier such as carbon black is positioned adjacent the top layer and a transparent cover sheet. The cover sheet comprises a transparent support which is coated with a neutralizing layer and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the film unit. The silver halide layers are developed and dye images are formed as a function of development. The dyes diffuse to the image-receiving layer to provide an image which is viewed through the transparent support on the opaque reflecting layer background. The timing layers break down after a period of time and make available materials to neutralize the alkaline processing composition and to shut down further silver halide development. For further details concerning the format of this particular integral film unit, reference is made to the above-mentioned Canadian Pat. No. 928,559, which is incorporated herein by reference.

The film unit of the present invention may be used to produce positive images in single- or multi-colors, as well as in black and white. In a three-color system, each silver halide emulsion layer of the film assembly will have associated therewith a dye image-providing material capable of providing a dye having a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous the silver halide emulsion layer.

The concentration of the dye image-providing materials that are employed in the present invention may be varied over a wide range depending upon the particular compound employed and the results which are desired. For example, the dye image-providing compounds may be coated as dispersions in layers by using coating compositions containing a weight ratio between about 0.25 and about 4 of the dye image-providing compound to the hydrophilic film-forming natural material or synthetic polymer binder, such as gelatin, polyvinyl alcohol, etc., which is adapted to be permeated by aqueous alkaline processing composition.

Generally, most silver halide developing agents can be employed to develop the silver halide emulsions in the photographic elements of this invention. The developer may be employed in the photosensitive element to be activated by the alkaline processing composition. Specific examples of developers which can be employed in this invention include:

hydroquinone
phenylcatechol
N-methylaminophenol
Phenidone (1-phenyl-3-pyrazolidinone)
Dimezone (1-phenyl-4,4-dimethyl-3-pyrazolidinone)
aminophenols
N,N-diethyl-p-phenylenediamine
3-methyl-N,N-diethyl-p-phenylenediamine
N,N,N',N'-tetramethyl-p-phenylenediamine
4-hydroxymethyl-4-methyl-1-phenyl-3-pyrazolidinone
etc.

In using redox dye-releaser compounds in this invention, diffusible dye images are produced as a function of developemtn of the silver halide emulsions. If the silver halide emulsion employed forms a direct-positive silver image, such as a direct-reversal internal-image emulsion or a solarizing emulsion, which is developable in unexposed areas, a positive image can be obtained on the dye image-receiving layer when redox releasers are employed which release dye where oxidized. After exposure of the film unit, the alkaline processing composition permeates the various layers to initiate development in the exposed photosensitive silver halide emulsion layers. The developing agent present in the film unit develops each of the silver halide emulsion layers in the unexposed areas (because the silver halide emulsions are direct-positive ones), thus causing the developing agent to become oxidized imagewise corresponding to the unexposed areas of the direct-positive silver halide emulsion layers. The oxidized developing agent then crossoxidizes the redox dye-releaser compound, the oxidized form of which either releases directly or undergoes a base-catalyzed reaction to release the preformed dyes or the dye precursors imagewise as a function of the imagewise exposure of each of the silver halide emulsion layers. At least a portion of the imagewise distributions of diffusible dyes or dye precursors diffuses to the image-receiving layer to form a positive image of the original subject.

Internal-image silver halide emulsions useful in the above-described embodiment are direct-positive emulsions that form latent images predominantly inside the silver halide grains, as distinguished from silver halide grains that form latent images predominantly on the surface thereof. Such internal-image emulsions were described by Davey et al in U.S. Pat. No. 2,592,250 issued Apr. 8, 1952, and elsewhere in the literature. Other useful emulsions are described in U.S. Pat. Nos. 3,761,276, 3,761,266 and 3,761,267, all issued Sept. 25, 1973. Internal-image silver halide emulsions can be defined in terms of the increased maximum density obtained when developed to a negative silver image with "internal-type" developers over that obtained when developed with "surface-type" developers. Suitable internal-image emulsions are those which, when measured according to normal photographic techniques by coating a test portion of the silver halide emulsion on a transparent support, exposing to a light-intensity scale having a fixed time between 0.01 and 1 sec., and developing for 3 min. at 20° C. in Developer A below ("internal-type" developer), have a maximum density at least 5 times the maximum density obtained when an equally exposed silver halide emulsion is developed for 4 min. at 20° C. in Developer B described below ("surface-type" developer). Preferably, the maximum density in Developer A is at least 0.5 density unit greater than the maximum density in Developer B.

| | |
|---|---|
| **Developer A** | |
| hydroquinone | 15 g. |
| monomethyl-p-aminophenol sulfate | 15 g. |
| sodium sulfite (desiccated) | 50 g. |
| potassium bromide | 10 g. |
| sodium hydroxide | 25 g. |
| sodium thiosulfate | 20 g. |
| water to make 1 liter | |
| **Developer B** | |
| p-hydroxyphenylglycine | 10 g. |
| sodium carbonate | 100 g. |
| water to make 1 liter | |

The internal-image silver halide emulsions when processed in the presence of fogging or nucleating agents provide direct-positive silver images. Such emulsions are particularly useful in the above-described embodiment. Suitable fogging agents include the hydrazines disclosed by Ives, U.S. Pat. Nos. 2,588,982 issued Mar. 11, 1952, and 2,563,785 issued Aug. 7, 1951; the hydrazides and hydrazones disclosed by Whitmore, U.S. Pat. No. 3,227,552 issued Jan. 4, 1966; hydrazone quaternary salts described in British Pat. No. 1,285,835 and U.S. Pat. No. 3,615,615; hydrazone-containing polymethine dyes described in U.S. Pat. No. 3,718,470; and the fogging agents disclosed in copending applications Ser. Nos. 601,891 and 601,888 of Leone et al filed Aug. 6, 1975, both assigned to Eastman Kodak Company, or mixtures thereof. The quantity of fogging agent employed can be widely varied depending upon the results desired. Generally, the concentration of fogging agent is from about 0.4 to about 8 g. per mole of silver in the photosensitive layer in the photosensitive element or from about 0.1 to about 2 g. per liter of developer if it is located in the developer. The fogging agents described in U.S. Pat. Nos. 3,615,615 and 3,718,470, however, are preferably used in concentrations of 50 to 400 mg. per mole of silver in the photosensitive layer.

Typical useful direct-positive emulsions are disclosed in U.S. Pat. Nos. 3,227,552 by Whitmore issued Jan. 4, 1966, 3,761,276 by Evans issued Sept. 25, 1973, 3,761,267 by Gilman et al, 3,761,266 by Milton, 3,703,584 by Motter, and the like.

In other embodiments, the direct-positive emulsions can be emulsions which have been fogged either chemically or by radiation on the surface of the silver halide grains to provide for development to maximum density without exposure. Upon exposure, the exposed areas do not develop, thus providing for image discrimination and a positive image. Silver halide emulsions of this type are very well-known in the art and are disclosed, for example, in U.S. Pat. Nos. 3,367,778 by Berriman issued Feb. 6, 1968, and 3,501,305, 3,501,306 and 3,501,307 by Illingsworth, all isued Mar. 17, 1970.

In still other embodiments, the direct-positive emulsions can be of the type described by Mees and James, *The Theory of the Photographic Process,* published by MacMillan Co., New York, N.Y., 1966, pp. 149–167.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention can be of the type disclosed in U.S. Pat. Nos. 2,543,181, 2,643,886, 2,653,732, 2,723,051, 3,056,492, 3,056,491 and 3,152,515. In general, such containers comprise a rectangular sheet of fluid- and air-impervious material folded longitudinally upon itself to form two walls which are sealed to one another along their longitudinal and end margins to form a cavity in which the processing solution of this invention is contained.

In a color photographic film unit according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104, 3,043,692, 3,044,873, 3,061,428, 3,069,263, 3,069,264, 3,121,011 and 3,427,158.

Generally speaking, except where noted otherwise, the silver halide emulsion layers in the invention comprise photosensitive silver halide dispersed in gelatin and are about 0.25 to 5 microns in thickness; the dye image-providing materials are dispersed in an aqueous alkaline solution-permeable polymeric binder, such as gelatin, as a separate layer about 0.25 to 5 microns in thickness; and the alkaline solution-permeable polymeric interlayers, e.g., gelatin, are about 0.25 to 5 microns in thickness. Of course, these thicknesses are approximate only and can be modified according to the product desired.

The alkaline solution-permeable, light-reflective layer employed in certain embodiments of photographic film units of this invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix, such as, for example, gelatin, polyvinyl alcohol, and the like. Brightening agents such as the stilbenes, coumarins, triazines and oxazoles can also be added to the light-reflective layer, if desired. When it is desired to increase the opacifying capacity of the light-reflective layers, dark-colored opacifying agents, e.g., pH-indicator dyes may be added to it, or carbon black, nigrosine dyes, etc., may be coated in a separate layer adjacent the light-reflective layer.

The neutralizing layer, if employed in this invention, becomes operative after permeation of the processing composition through the timing layers and will effect a reduction in the pH of the image layers from about 13 or 14 to at least 11 and preferably 5–8 within a short time after imbibition. For example, polymeric acids as disclosed in U.S. Pat. No. 3,362,819 or solid acids or metallic salts, e.g., zinc acetate, zinc sulfate, magnesium acetate, etc., as disclosed in U.S. Pat. No. 2,584,030 may be employed with good results. Such neutralizing or pH-lowering materials reduce the pH of the film unit after development to terminate development and substantially reduce further dye transfer and thus stabilize the dye image.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymeric mordants such as polymers of amino quanidine derivatives of vinyl methyl ketone such as described by Minsk, U.S. Pat. No. 2,882,156 issued Apr. 14, 1959, and basic polymeric mordants such as described in U.S. Pat. Nos. 3,709,690, 3,625,694, 3,898,088 by Cohen et al issued Aug. 5, 1975, and 3,859,096 by Burness et al issued Jan. 7, 1975. Other mordants useful in this invention include poly-4-vinylpyridine, the 2-vinylpyridine polymer metho-p-toluene sulfonate and similar compounds described by Sprague et al, U.S. Pat. No. 2,484,430 issued Oct. 11, 1949, and cetyl trimethylammonium bromide, etc. Effective mordanting compositions can also described in U.S. Pat. Nos. 3,271,148 by Whitmore and 3,271,147 by Bush, both issued Sept. 6, 1966, and in U.S. Pat. No. 3,958,995, issued May 25, 1976.

Other materials useful in the dye image-receiving layer include alkaline solution-permeable polymeric layers such as N-methoxymethyl polyhexylmethylene adipamide, partially hydrolyzed polyvinyl acetate and other materials of a similar nature. Generally, good results are obtained when the image-receiving layer, preferably alkaline solution-permeable, is transparent and about 0.25 to about 5μ in thickness. This thickness, of course, can be modified depending upon the result desired. The image-receiving layer can also contain ultraviolet-absorbing materials, to protect the mordanted dye images from fading due to ultraviolet light, and brightening agents such as the stilbenes, coumarins, triazines oxazoles, dye stabilizers such as the chromanols, alkylphenols, etc.

The support for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethyleneterephthalate) film, polycarbonate film, poly-α-olefins such as polyethylene and polypropylene film, and related films or resinous materials. The support is usually about 2 to 9 mils (50–225 μm) in thickness. Ultraviolet-absorbing materials may also be included in the supports or as a separate layer on the supports, if desired.

The silver halide emulsions useful in this invention are well-known to those skilled in the art and are described in *Product Licensing Index*, Vol. 92, December, 1971, publication 9232, p. 107, paragraph I, "Emulsion types". They may be chemically and spectrally sensitized as described on p. 107, paragraph III, "Chemical Sensitization", and pp. 108–109, paragraph XV, "Spectral sensitization", of the above article; they can be protected against the production of fog and can be stabilized against loss of sensitivity during keeping by employing the materials described on p. 107, paragraph V, "Antifoggants and stabilizers", of the above article; they can contain development modifiers, hardeners, and coating aids as described on pp. 107–108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on p. 108, paragraph XI, "Plasticizers and lubricants", and paragraph VIII, "Vehicles", and p. 109, paragraph XVI, "Absorbing and filter dyes", of the above article; they and other layers in the photographic elements used in this invention may contain addenda which are incorporated by using the procedures described on p, 109, paragraph XVII, "Methods of addition", of the above article; and they can be coated using the various techniques described on p. 109, paragraph XVIII, "Coating procedures", of the above article; the disclosures of which are hereby incorporated by reference.

The following examples illustrate the invention.

EXAMPLE 1

A photographic product A is prepared which comprises a single cyan dye image-forming element. For this effect, there is applied on a poly(ethylene terephthalate) support:

(1) a photosensitive silver halide layer, comprising a negative photosensitive silver halide emulsion, with silver content of 15 mg./dm.$^2$, a cyan image dye-providing compound, with content of 10 mg./dm.$^2$, which corresponds to the following formula:

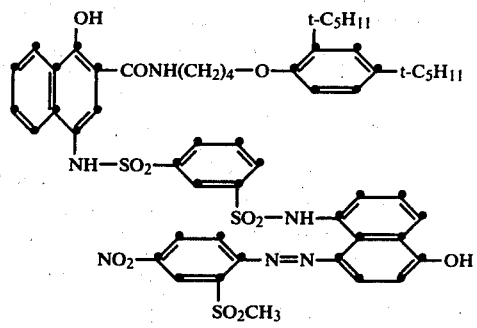

and a silver halide developer incorporated as the acetate of 4,4-dimethyl-1-phenyl-3-pyrazolidone with content of 2 mg./dm.$^2$; and (2) a protective gelatin overcoating with gelatin content of 12 mg./dm.$^2$.

A second photographic product B is prepared similar to product A, except that silver halide developer is 4-hydroxymethyl-4-methyl-1-phenyl-3-pyrazolidone with a content of 2 mg./dm.$^2$.

The photographic products A and B are exposed behind a shading (or color) scale. Exposed samples of the photographic products A and B are treated respectively by using a control process (in the absence of amino acid) and by using the process according to the invention (in the presence of amino acid).

The sequences of treatment are the following:

| | |
|---|---|
| Sequence I (control process) | |
| 1 - control alkaline processing composition (1) | 2 min. |
| 2 - bleaching-fixing bath* | 5 min. |
| 3 - alkaline processing composition (1) | 5 min. |
| Sequence II (according to the invention) | |
| 1 - alkaline processing composition (2) according to the invention | 2 min. |
| 2 - bleaching-fixing bath* | 5 min. |
| 3 - alkaline processing composition (1) | 5 min. |

The treatment solutions used comprise the following constituents:

| | |
|---|---|
| Alkaline processing composition 1 | |
| potassium hydroxide | 60 g. |
| potassium bromide | 10 g. |
| hydroxyethyl cellulose | 30 g. |
| water to make 1 liter | |
| Alkaline processing composition 2 according to the invention | |
| potassium hydroxide | 60 g. |
| potassium bromide | 10 g. |
| hydroxyethyl cellulose | 30 g. |
| 4-aminobutyric acid - $NH_2$—$(CH_2)_3$—COOH | 30 g. |
| water to make 1 liter | |
| *The bleaching-fixing bath contains the following constituents: | |
| monosodium salt of the ferric complex of ethylenediamine tetraacetic acid | 60 g. |
| neutral sodium sulfite | 12 g. |
| ammonium thiocyanate | 12 g. |
| ammonium thiosulfate | 120 g. |
| water to make 1 liter | |
| The pH is adjusted to 6.5. | |

The treatments (1) and (2) are carried out by the alkaline processing composition using a receiving sheet such as a mordanted paper support which has been impregnated with activator. The bleaching-fixing treatment (2) is carried out in a tray.

As has been mentioned above, the alkaline processing composition used in stage (1) of the treatment has the purpose particularly of bringing about (a) the development of the exposed silver halides with formation of the oxidized developer and (b) the splitting of the molecule of image dye-providing compound by reaction of the oxidized developer in a basic medium with liberation of a diffusible dye which is fixed on the mordanted receiving sheet impregnated with basic activator. The bleaching-fixing bath used in stage (2) makes it possible to eliminate the silver halides of the unexposed and undeveloped regions and the silver image of the exposed and developed regions. The alkaline processing composition used again in stage (3) makes it possible to complete the elimination of the liberated azo dye.

The values of the minimum and maximum densities of the retained cyan dye images are determined, as well as the discrimination (Dmax-Dmin). The results obtained are mentioned in Table 1.

TABLE 1

| Product | | Dmin | Dmax | Discrimination (Dmax-Dmin) |
|---|---|---|---|---|
| A | alkaline processing composition 1 | 0.90 | 2.60 | 1.70 |
| A | alkaline processing composition 2 according to the invention | 0.32 | 2.60 | 2.28 |
| B | alkaline processing composition 1 | 0.80 | 2.25 | 1.75 |
| B | alkaline processing composition 2 according to the invention | 0.24 | 2.60 | 2.36 |

The results of Table 1 show that the process according to the invention, which employs amino acids during the silver development, and the diffusion, in the presence of basic activator, of the diffusible dye to the mordanted receiving sheet, insures a more rapid and more complete diffusion of the dye, and the residual minimum density is greatly reduced and the discrimination of the cyan image dye-providing compound image is clearly improved.

EXAMPLE 2

The method of Example 1 was essentially reproduced except that a multilayer photographic product was used comprising three dye image forming layers, respectively cyan, magenta and yellow. This product has the following structure:

(1) overlayer of gelatin (12 mg./dm.$^2$) which contains the acetate of 4,4-dimethyl-1-phenyl-3-pyrazolidone (1 mg./dm.$^2$) and 2,5-didodecyl hydroquinone (6 mg./dm.$^2$);

(2) layer of gelatino-silver halide emulsion (content of Ag=20.6 mg./dm.$^2$) which contains acetate of 4,4-dimethyl-1-phenyl-3-pyrazolidone (1 mg./dm.$^2$), a yellow image dyeproviding compound (formula below) with a content of 7.5 mg./dm.$^2$, and 1-phenyl-5-(2-cyanoethylthio)tetrazole (0.01 mg./dm.$^2$);

(3) interlayer of gelatin (12 mg./dm.$^2$), which contains a colloidal dispersion of Carey-Lea silver (Ag content=1 mg./dm.$^2$), acetate of 4,4-dimethyl-1-phenyl-3-pyrazolidone (1 mg./dm.$^2$) and 2,5-didodecyl hydroquinone (6 mg./dm.$^2$);

(4) layer of gelatino-silver halide emulsion (Ag content=15.4 mg./dm.$^2$) which contains the acetate of 4,4-dimethyl-1-phenyl-3-pyrazolidone (1 mg./dm.$^2$), a magenta image dye-providing compound (formula below) with a content of 10 mg./dm.$^2$, and 1-phenyl-5-(2-cyanoethylthio)tetrazole (0.005 mg./dm.$^2$);

(5) interlayer of gelatin (12 mg./dm.$^2$) which contains acetate of 4,4-dimethyl-1-phenyl-3-pyrazolidone (1 mg./dm.$^2$) and 2,5-didodecyl hydroquinone (6 mg./dm.$^2$);

(6) layer of gelatino-silver halide emulsion (silver content 20 mg./dm.$^2$) which contains acetate of 4,4-dimethyl-1-phenyl-3-pyrazolidone (1.5 mg./dm.$^2$), the cyan image dye-providing compound of Example 1 (10 mg./dm.$^2$), and 1-phenyl-5-(2-cyanoethylthio)tetrazole (0.01 mg./dm.$^2$);

(7) a support of poly(ethyleneterephthalate).

The yellow image dye-providing compound corresponds to the following formula:

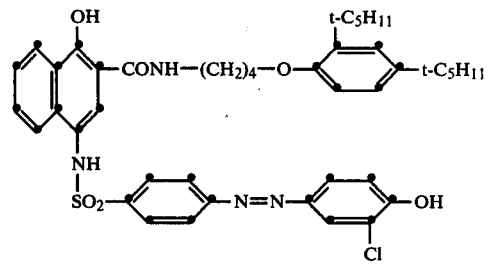

The magenta image dye-providing compound corresponds to the following formula:

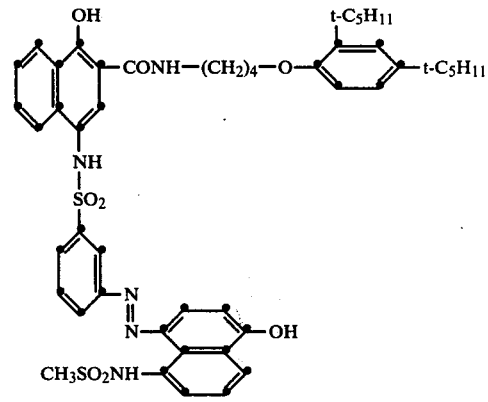

This photographic product is exposed behind a shade (or color) scale, and samples of the photographic product are treated respectively by carrying out a control process and the process according to the invention, using the treatment solutions described in Example 1.

The sequences of treatment are the following:

| | |
|---|---|
| Sequence III (control process) | |
| 1 - control alkaline processing composition 1 | 3 min. |
| 2 - bleaching-fixing bath | 5 min. |
| 3 - alkaline processing composition 1 | 5 min. |
| Sequence IV (process according to the invention) | |
| 1 - alkaline processing composition 2 | 3 min. |

-continued

| | |
|---|---|
| according to the invention | |
| 2 - bleaching-fixing bath | 5 min. |
| 3 - alkaline processing composition 1 | 5 min. |

The results obtained are shown in Table 2.

TABLE 2

| Alkaline Processing Composition | | Dmin | Dmax | Discrimination (Dmax-Dmin) |
|---|---|---|---|---|
| 1 (control) | yellow | 0.85 | 1.85 | 1.00 |
| | magenta | 0.70 | 2.35 | 1.65 |
| | cyan | 1.30 | 3.30 | 2.00 |
| 2 (according to the invention) | yellow | 0.60 | 2.20 | 1.60 |
| | magenta | 0.45 | 2.75 | 2.30 |
| | cyan | 0.60 | 3.55 | 2.95 |

The results of Table 2 show that the process according to the invention which utilizes the alkaline processing composition 2 which contains 4-aminobutyric acid makes it possible to decrease the minimum densities very clearly and to increase the discriminations of the three images of yellow, magenta and cyan dyes, in comparison with the process of the prior art which uses only the control alkaline processing composition 1. This improvement of the Dmin is particularly notable for the cyan dye image. (The contents of developed silver, using the control process and the process according to the invention, are practically identical for each region corresponding to an identical step of the shade scale.)

The operating method of Example 2 is reproduced, but using alkaline processing composition according to the invention, the concentration of 4-aminobutyric acid being respectively equal to 10 g/l, 20 g/l and 50 g/l. The results obtained as to the Dmin and the discrimination (Dmax-Dmin) for each of the dye images of dyes are clearly better than those of the control test of Example 2 (Table 2).

Further, the method of Example 2 was reproduced, except that the 4-aminobutyric acid in the alkaline processing composition 2 according to the invention was replaced, respectively, by the following amino acids:

2-aminoacetic acid
6-aminohexanoic acid
2-aminoethylsulfonic acid
8-aminooctanoic acid
11-aminoundecanoic acid
at a concentration of 30 g/l.

The results obtained were clearly favorable compared with those of the control test of Example 2.

EXAMPLE 3

Examples 3 and 4 show that amino acids can be incorporated into photographic products according to the invention. As has been mentioned above, these amino acids can be incorporated in each element, forming an image of residual image dye-providing compound, advantageously in each interlayer of gelatin.

Two photographic products A and B according to the invention are prepared in which are incorporated, respectively, 4-aminobutyric acid and 6-aminohexanoic acid. These photographic products A and B have the following structure:

(1) overlayer of gelatin (gelatin content=12 mg./dm.$^2$) which contains the acetate of 4,4-dimethyl-1-phenyl-3-pyrazolidone (1 mg./dm.$^2$), 2,5-didodecyl hydroquinone (6 mg./dm.$^2$), and the amino acid (7.2 mg./dm.$^2$);

(2) layer of gelatino-silver halide emulsion (content of Ag=20.6 mg./dm.$^2$) which contains the acetate of 4,4-dimethyl-1-phenyl-3-pyrazolidone (1 mg./dm.$^2$), the yellow image dye-providing compound of Example 2 (10 mg./dm.$^2$), and 1-phenyl-5-(2-cyanoethylthio)tetrazole (0.01 mg./dm.$^2$);

(3) interlayer of gelatin (gelatin content=12 mg./dm.$^2$) which contains the acetate of 4,4-dimethyl-1-phenyl-3-pyrazolidone (1 mg./dm.$^2$), Carey-Lea colloidal silver (content of Ag=1 mg./dm.$^2$), 2,5-didodecyl hydroquinone (6 mg./dm.$^2$), and the amino acid (4.1 mg./dm.$^2$);

(4) layer of gelatino-silver halide emulsion (content of Ag=15.4 mg./dm.$^2$) which contains the acetate of 4,4-dimethyl-1-phenyl-3-pyrazolidone (1 mg./dm.$^2$), the magenta image dye-providing compound of Example 2 at a content of 10 mg./dm.$^2$), and 1-phenyl-5-(2-cyanoethylthio)tetrazole (0.005 mg./dm.$^2$);

(5) interlayer of gelatin (gelatin content=12 mg./dm.$^2$) which contains the acetate of 4,4-dimethyl-1-phenyl-3-pyrazolidone (1 mg./dm.$^2$), 2,5-didodecyl hydroquinone (6 mg./dm.$^2$), and the amino acid (7.2 mg./dm.$^2$);

(6) layer of gelatino-silver halide emulsion (content of Ag=17 mg./dm.$^2$) which contains the acetate of 4,4-dimethyl-1-phenyl-3-pyrazolidone (1.5 mg./dm.$^2$), the cyan image dye-providing compound of Example 1 at a content of 8.6 mg./dm.$^2$, and 1-phenyl-5-(2-cyanoethylthio)tetrazole (0.05 mg./dm.$^2$).

These products were compared to a control photographic product C which contains no amino acid.

The photographic products A, B and C were exposed as in Example 2, and treated according to Sequence III described in Example 2. (The two alkaline processing compositions used contain no amino acid.) The results obtained are shown in Tables 3, 4 and 5.

TABLE 3

| | | Dmin | Dmax | Discrimination (Dmax-Dmin) |
|---|---|---|---|---|
| control - product C | yellow | 1.1 | 2.60 | 1.50 |
| | magenta | 0.90 | 2.70 | 1.80 |
| | cyan | 1.10 | 2.60 | 1.50 |

TABLE 4

| | | Dmin | Dmax | Discrimination (Dmax-Dmin) |
|---|---|---|---|---|
| Product A according to the invention (contains 4-aminobutyric acid) | yellow | 0.80 | 1.95 | 1.15 |
| | magenta | 0.50 | 2.45 | 1.95 |
| | cyan | 0.45 | 2.50 | 2.05 |

TABLE 5

| | | Dmin | Dmax | Discrimination (Dmax-Dmin) |
|---|---|---|---|---|
| Product B according to the invention (contains 6-aminohexanoic | yellow | 0.80 | 1.90 | 1.10 |
| | magenta | 0.60 | 2.55 | 1.95 |
| | cyan | 0.60 | 2.65 | 2.05 |

TABLE 5-continued

| | | Dmin | Dmax | Discrimination (Dmax-Dmin) |
|---|---|---|---|---|
| acid) | | | | |

The results of Tables 3, 4 and 5 show that the photographic products according to the invention, which contain incorporated amino acids, make it possible to obtain dye images whose Dmin is clearly improved. It will be noted, moreover, that the discrimination of the magenta and cyan dye images is also improved.

EXAMPLE 4

The method of Example 3 was reproduced, except that the sequence of treatment IV described in Example 2 which uses, in the first stage, the alkaline processing composition 2 which contains 4-aminobutyric acid (30 g/l) was used. The results obtained are shown in Tables 6, 7 and 8.

TABLE 6

| | | Dmin | Dmax | Discrimination (Dmax-Dmin) |
|---|---|---|---|---|
| Product C (without amino acid) | yellow | 0.85 | 2.50 | 1.65 |
| | magenta | 0.60 | 3.15 | 2.55 |
| | cyan | 0.60 | 2.50 | 1.90 |

TABLE 7

| | | Dmin | Dmax | Discrimination (Dmax-Dmin) |
|---|---|---|---|---|
| Product A (contains 4-aminobutyric acid) | yellow | 0.80 | 2.50 | 1.70 |
| | magenta | 0.60 | 3.15 | 2.55 |
| | cyan | 0.60 | 2.75 | 2.15 |

TABLE 8

| | | Dmin | Dmax | Discrimination (Dmax-Dmin) |
|---|---|---|---|---|
| Product B (contains 6-aminohexanoic acid) | yellow | 0.55 | 2.25 | 1.70 |
| | magenta | 0.45 | 2.90 | 2.45 |
| | cyan | 0.50 | 2.60 | 2.10 |

EXAMPLE 5

The method of Example 4 was reproduced, except that the following sequence of treatment V was used:

| Sequence V (process and alkaline processing composition 3 according to the invention) | |
|---|---|
| 1 - alkaline processing composition 3 according to the invention | 3 min. |
| 2 - bleaching-fixing bath (described in Example 1) | 5 min. |
| 3 - alkaline processing composition 1 (described in Example 1) | 5 min. |

The alkaline processing composition 3 according to the invention comprises the following constituents:

| | |
|---|---|
| potassium hydroxide | 60 g. |
| potassium bromide | 10 g. |

-continued

| | |
|---|---|
| hydroxyethyl cellulose | 30 g. |
| 6-aminohexanoic acid | 30 g. |
| water to make | 1 l. |

Tables 9, 10 and 11 show the results obtained.

TABLE 9

| | | Dmin | Dmax | Discrimination (Dmax-Dmin) |
|---|---|---|---|---|
| Product C (without amino acid) | yellow | 0.70 | 2.30 | 1.60 |
| | magenta | 0.45 | 2.75 | 2.30 |
| | cyan | 0.50 | 2.50 | 2.00 |

TABLE 10

| | | Dmin | Dmax | Discrimination (Dmax-Dmin) |
|---|---|---|---|---|
| Product A (contains 4-aminobutyric acid) | yellow | 0.55 | 2.20 | 1.65 |
| | magenta | 0.40 | 2.90 | 2.50 |
| | cyan | 0.35 | 2.65 | 2.30 |

TABLE 11

| | | Dmin | Dmax | Discrimination (Dmax-Dmin) |
|---|---|---|---|---|
| Product B (contains 6-aminohexanoic acid) | yellow | 0.85 | 2.05 | 1.20 |
| | magenta | 0.60 | 2.40 | 1.80 |
| | cyan | 0.55 | 2.50 | 1.95 |

The results of Examples 4 and 5 (Tables 6–11) show that, when the process according to the invention uses a photographic product and an alkaline processing composition which contains an amino acid, images of image dye-providing compounds are obtained whose Dmins are clearly improved in comparison with those which can be obtained by a process of the prior art, in the absence of amino acid.

EXAMPLE 6

The method of Example 5 was reproduced, except that the following treatment Sequence VI was used:

| Sequence VI | |
|---|---|
| 1 - alkaline processing composition 4 according to the invention | 1 min. |
| 2 - bleaching-fixing bath of Example 1 | 2 min., 30 sec. |
| 3 - alkaline processing composition 1 | 3 min. |

Alkaline processing composition 4 according to the invention comprises the following constituents:

| | |
|---|---|
| potassium hydroxide | 40 g/l |
| potassium bromide | 10 g/l |
| hydroxyethyl cellulose | 30 g/l |
| n-butylamine | 10 g/l |
| butyric acid | 10 g/l |

Two control tests were carried out by using, in alkaline processing composition 4, either only n-butylamine or only butyric acid. The results are shown in Table 12 below:

TABLE 12

| Activator (g./l.) | | Dmin | Dmax | Discrimination |
|---|---|---|---|---|
| n-butylamine (10) + butyric acid (10) (according to the invention) | yellow | 0.68 | 2.65 | 1.97 |
| | magenta | 0.36 | 2.45 | 2.09 |
| | cyan | 0.33 | 2.73 | 2.40 |
| n-butylamine (30) (control) | yellow | 1.50 | 3.87 | 2.37 |
| | magenta | 1.48 | 3.96 | 2.48 |
| | cyan | 1.95 | 3.60 | 1.65 |
| butyric acid (control) (30) | yellow | 1.86 | 2.90 | 1.04 |
| | magenta | 1.65 | 2.36 | 0.71 |
| | cyan | 2.05 | 2.73 | 0.68 |

The results of Table 12 show that the combination of n-butylamine and butyric acid used according to the invention makes it possible to obtain Dmins which are clearly improved in comparison with the Dmins obtained in the control tests.

EXAMPLE 7

The method of Example 2 was reproduced, except that 11-aminoundecanoic acid (30 g/l) was used in the alkaline processing composition according to the invention. On the other hand, a control test was carried out with an alkaline processing composition without amino acid. The results obtained are shown in Table 13.

TABLE 13

| Activator (g./l.) | | Dmin | Dmax | Discrimination |
|---|---|---|---|---|
| 11-aminoundecanoic acid (30) (according to the invention) | yellow | 0.46 | 2.73 | 2.27 |
| | magenta | 0.30 | 3.13 | 2.83 |
| | cyan | 0.27 | 2.98 | 2.71 |
| control activator | yellow | 0.94 | 2.86 | 1.92 |
| | magenta | 0.73 | 3.00 | 2.27 |
| | cyan | 0.99 | 2.77 | 1.78 |

The results of Table 13 show that the photographic product treated according to the invention shows Dmins and discriminations clearly improved in comparison with those obtained by the control process.

EXAMPLE 8

This example shows that the process according to the invention can be applied to obtain dye images by diffusion transfer on a mordanted support.

A photographic product was used which is capable of furnishing an image in colors by diffusion, according to an image, of dyes onto a mordanted receiving layer as described, for example, in French Pat. No. 2,309,901. This product was exposed in a sensitometer and developed by an alkaline processing composition according to the invention which contains 4-aminobutyric acid. A control test was carried out in the absence of amino acid.

The alkaline processing composition used contain the following constituents:

| Constituent (g/l) | Control Alkaline Processing Composition | Alkaline Processing Composition According to the Invention |
|---|---|---|
| potassium hydroxide | 60 | 60 |
| KBr | 20 | 20 |
| bis-methylsulfonyl methane | 8 | 8 |
| $AgNO_3$ | 3 | 3 |
| hydroxyethyl cellulose | 30 | 30 |
| 4-aminobutyric acid | 0 | 20 |

The dye densities obtained as a function of the duration of development are shown in Tables 14 and 15 below:

TABLE 14

| Control Test | Duration of Development (Min.) | | | | | | | | | | | | | | | |
|---|---|---|---|---|---|---|---|---|---|---|---|---|---|---|---|---|
| Densities: | 0.5 | 1 | 1.5 | 2 | 2.5 | 3 | 3.5 | 4 | 4.5 | 5 | 5.5 | 6 | 6.5 | 7 | 7.5 | 8 |
| read in blue | 0.10 | 0.13 | 0.44 | 0.80 | 1.10 | 1.28 | 1.43 | 1.59 | 1.72 | 1.81 | 1.90 | 1.99 | 2.04 | 2.10 | 2.14 | 2.20 |
| read in green | 0.16 | 0.16 | 0.44 | 0.83 | 1.10 | 1.28 | 1.38 | 1.52 | 1.58 | 1.66 | 1.72 | 1.78 | 1.82 | 1.86 | 1.91 | 1.96 |
| read in red | 0.20 | 0.20 | 0.58 | 1.32 | 1.68 | 1.88 | 1.95 | 2.00 | 2.05 | 2.06 | 2.08 | 2.09 | 2.10 | 2.11 | 2.12 | 2.12 |

TABLE 15

| Test According to the Invention | Duration of Development (Min.) | | | | | | | | | | | | | | | |
|---|---|---|---|---|---|---|---|---|---|---|---|---|---|---|---|---|
| Densities: | 0.5 | 1 | 1.5 | 2 | 2.5 | 3 | 3.5 | 4 | 4.5 | 5 | 5.5 | 6 | 6.5 | 7 | 7.5 | 8 |
| read in blue | 0.13 | 0.16 | 0.50 | 1 | 1.27 | 1.56 | 1.76 | 1.96 | 2.10 | 2.24 | 2.32 | 2.42 | 2.5 | >2.5 | | |
| read in green | 0.16 | 0.18 | 0.56 | 1 | 1.26 | 1.48 | 1.67 | 1.80 | 1.94 | 2.05 | 2.12 | 2.20 | 2.28 | 2.34 | 2.38 | 2.43 |
| read in red | 0.20 | 0.20 | 0.98 | 1.54 | 1.97 | 2.12 | 2.22 | 2.27 | 2.30 | 2.32 | 2.33 | 2.36 | 2.38 | 2.39 | 2.40 | 2.40 |

The results of Tables 14 and 15 show that the densities of dyes transferred in the presence of amino acid for a determined duration of development are much higher than those which are obtained in the absence of amino acids.

EXAMPLE 9

A photographic element was prepared according to the following schematic structure: (The numerical values denote quantity in g./m.$^2$.)

| |
|---|
| gelatin - 1.08 |
| gelatin - 2.15/image dye-providing compound |
| (A)* - 1.33/red-sensitive, negative-working |
| AgX emulsion - 1.08 Ag |

-continued

| film support |
|---|

*image dye-providing compound (A)

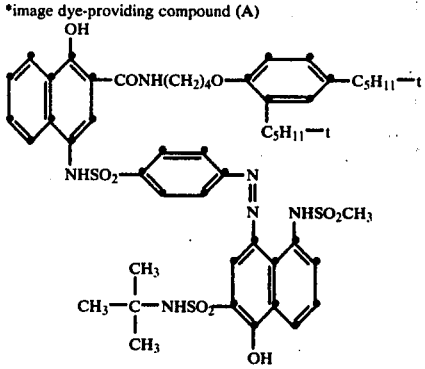

Samples of the element were imagewise-exposed through a graduated-density test object and developed in developers with pH's 10.0, 10.5, 11.0, 11.5, 12.0, 12.5 and 13.7, with and without 11-aminoundecanoic acid, washed, bleach-fixed, washed and buffered at pH 7, at 100° F. (38° C.).

The developer formulations for pH's 10 through 12.5 were as follows:

| | | |
|---|---|---|
| $Na_3PO_4$ | 39 | g./l. |
| KBr | 10 | g./l. |
| $Na_2SO_3$ | 4.8 | g./l. |
| 5-methylbenzotriazole | .1 | g./l. |
| 4-hydroxymethyl-4-methyl-1-phenyl-3-pyrazolidone | .3 | g./l. |
| 11-aminoundecanoic acid | ±2 | g./l. |
| pH adjusted with NaOH | | |

The pH 13.7 developer contained 20 g./l. KOH rather than a phosphate buffer.

After processing, positive magenta dye images were observed in all the samples; however, those processed with developer solutions containing 11-aminoundecanoic acid demonstrated lower minimum dye densities, especially at the lower pH levels.

EXAMPLE 10

A sample of the photographic element illustrated schematically below (the numerical values denoting quantity in g./m.$^2$) was exposed through a graduated-density test object and processed as in Example 9 except only the pH 11.5 and pH 13.7 developer solutions, with and without 11-aminoundecanoic acid (AUA), were used and the development time was 1 min. or 3 min. at 100° F. (38° C.).

| gelatin - 1.08 |
|---|
| gelatin - 2.68 / image dye-providing compound (A) - 0.97 / red-sensitive, negative-working AgX emulsion - 1.34 Ag |
| film support |

After processing, positive magenta dye images were observed in all the samples; however, those processed with 11-aminoundecanoic acid present in the developer solution generally demonstrated lower minimum dye densities and less yellow stain, especially in the pH 11.5 process. (See the table below.)

| Process | Temp. (F.) | pH | HMPP* | AUA | Blue Dmin | Green Dmin | Green Dmax | Ag° Emax |
|---|---|---|---|---|---|---|---|---|
| 1 min. | 100° | 11.5 | 0.3 | 0 | 0.30 | 0.98 | 3.46 | 37.9 |
| | | | | 2 | 0.15 | 0.22 | 3.54 | 50.9 |
| 3 min. | 100° | 11.5 | 0.3 | 0 | 0.24 | 0.58 | 3.36 | 52.6 |
| | | | | 2 | 0.16 | 0.18 | 3.28 | 68.2 |
| 1 min. | 100° | 13.7 | 0.3 | 0 | 0.30 | 0.26 | 3.42 | 50.4 |
| | | | | 2 | 0.26 | 0.26 | 3.30 | 45.0 |
| 3 min. | 100° | 13.7 | 0.3 | 0 | 0.28 | 0.22 | 2.14 | 57.6 |
| | | | | 2 | 0.21 | 0.16 | 1.51 | 60.2 |

*4-hydroxymethyl-4-methyl-1-phenyl-3-pyrazolidone

EXAMPLE 11

The samples of Example 10 were imagewise-exposed through a graduated-density test object and processed, at 100° F. (38° C.), by rupturing a pod containing a viscous processing composition consisting of 39 g. sodium phosphate, 10 g. potassium bromide, 4.8 g. sodium sulfite, 0.1 g. 5-methylbenzotriazole, 35 g. carboxymethyl cellulose, 1 g. 4-hydroxymethyl-4-methyl-1-phenyl-3-pyrazolidone (HMPP), with or without 2 g. 11-aminoundecanoic acid, per liter of water adjusted to pH 11.5 with sodium hydroxide while in contact with an image-receiving element consisting of a polyethylene-coated paper support having coated thereon a layer containing 2.15 g./m.$^2$ Mordant A* and 2.15 g./m.$^2$ gelatin.

*Mordant A

-continued

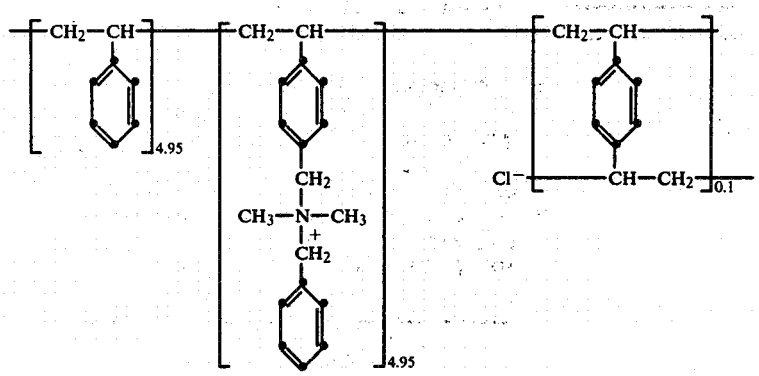

poly[styrene-co-N-vinylbenzyl-N,N-dimethyl-N-benzylammonium chloride-co-divinylbenzene]

Separate samples of the photographic elements were separated from the receiver sheets after 1, 3 or 6 min., respectively, washed, bleach-fixed, washed and buffered at pH 7 to produce positive retained magenta dye images.

The samples processed with 11-aminoundecanoic acid present in the viscous composition generally reduced minimum dye densities as shown below.

| Process | Temp. (F.) | pH | HMPP | AUA | Blue Dmin | Green Dmin | Green Dmax | Ag* Emax |
|---|---|---|---|---|---|---|---|---|
| 1 min. | 100° | 11.5 | 1 | 0 | 0.52 | 2.13 | 3.36 | 21.8 |
| | | | | 2 | 0.66 | 1.80 | 3.54 | 23.8 |
| 3 min. | 100° | 11.5 | 1 | 0 | 0.46 | 1.90 | 3.24 | 31.6 |
| | | | | 2 | 0.45 | 1.14 | 3.38 | 37.7 |
| 6 min. | 100° | 11.5 | 1 | 0 | 0.41 | 1.62 | 3.15 | 33.3 |
| | | | | 2 | 0.35 | 0.95 | 3.04 | 44.8 |

EXAMPLE 12

The samples which were exposed and processed in Example 11 to produce positive retained magenta dye images also produced negative transferred magenta dye images.

The sensitometric results, tabulated below, demonstrate that transferred dye images with improved image discrimination are produced when the samples are processed with 11-aminoundecanoic acid present in the viscous composition.

| Image Dye-Providing Compound (A) | | | | | |
|---|---|---|---|---|---|
| Process | Temp. | pH | HMPP | AUA | Green Image Discrimination (ΔD) |
| 1 min. | 100° F. | 11.5 | 1 | 0 | 0.44 |
| | | | | 2 | 0.45 |
| 3 min. | 100° F. | 11.5 | 1 | 0 | 0.81 |
| | | | | 2 | 1.05 |
| 6 min. | 100° F. | 11.5 | 1 | 0 | 1.08 |
| | | | | 2 | 1.38 |

EXAMPLE 13

Samples of the elements illustrated in Example 10 were sensitometrically exposed through a graduated-density test object.

The exposed samples, along with a corresponding number of samples of the image-receiving element described in Example 11, were imbibed with either a pH 11.5 or pH 13.7 processing solution, with and without 11-aminoundecanoic acid, for 20 sec. at 75° F. (24° C.).

| Composition of Processing Solutions A, B, C and D | | | | |
|---|---|---|---|---|
| | A (g./l.) | B (g./l.) | C (g./l.) | D (g./l.) |
| HMPP* | 0.3 | 0.3 | 1.0 | 1.0 |
| KBr | 10.0 | 10.0 | 2.0 | 2.0 |
| 5-methyl-benzotriazole | 0.1 | 0.1 | — | — |
| NaOH | 20.0 | 20.0 | — | — |
| $Na_3PO_4$ | | | 40.0 | 40.0 |
| AUA** | — | 2.0 | — | 2.0 |
| pH | 13.7 | 13.7 | 11.5 | 11.5 |

*4-hydroxymethyl-4-methyl-1-phenyl-3-pyrazolidone
**11-aminoundecanoic acid

The imbibed photosensitive samples were then brought into contact with their respective, similarly imbibed, receiver sheets.

Separate samples of the photographic elements were separated from the receiver sheets after 1, 3 or 5 min. respectively, washed, bleach-fixed, washed, and buffered at pH 7 to produce positive retained magenta dye images. Additionally, the washed receiver sheets contained negative transferred magenta dye images.

The sensitometric results, tabulated below, demonstrate the advantages of using 11-aminoundecanoic acid in a process where the exposed element is dipped in a processing solution and subsequently laminated to a mordanted receiver sheet, especially at reduced pH. The samples which were imbibed with Processing Solution D produced retained images with reduced minimum dye densities and transferred images with greater maximum dye densities.

| Lamination Time | Processing Solution | pH | AUA g./l. | Retained Image Green Dmin | Retained Image Green Dmax | Transferred Image Green Dmin | Transferred Image Green Dmax |
|---|---|---|---|---|---|---|---|
| 1 min. | C | 11.5 | 0 | 2.26 | 3.08 | 0.20 | 0.86 |
| 1 min. | D | 11.5 | 2 | 1.22 | 3.40 | 0.11 | 1.38 |
| 3 min. | C | 11.5 | 0 | 2.14 | 3.20 | 0.20 | 1.14 |
| 3 min. | D | 11.5 | 2 | 0.92 | 3.10 | 0.20 | 2.00 |
| 5 min. | C | 11.5 | 0 | 1.88 | 2.88 | 0.24 | 1.20 |
| 5 min. | D | 11.5 | 2 | 0.90 | 3.26 | 0.24 | 2.07 |
| 1 min. | A | 13.7 | 0 | 1.46 | 3.38 | 0.10 | 2.05 |
| 1 min. | B | 13.7 | 2 | — | — | 0.10 | 2.80 |
| 3 min. | A | 13.7 | 0 | 0.68 | 3.46 | 0.20 | 3.00 |
| 3 min. | B | 13.7 | 2 | 0.44 | 3.18 | 0.18 | 3.00 |
| 5 min. | A | 13.7 | 0 | 0.44 | 3.02 | 0.30 | 2.90 |
| 5 min. | B | 13.7 | 2 | 0.60 | 3.74 | 0.28 | 3.80 |

EXAMPLE 14

This example illustrates the use of amino acids to produce color images with improved image discrimination in retained imaging processes employing activator solutions at high pH.

A photographic element identified by the following schematic structure was prepared. The numerical values denote quantity in g./m.$^2$.

| |
|---|
| red-sensitive, negative-working AgX emulsion - Ag (1.08)/image dye-forming compound B* (1.38)/ gelatin (2.16) |
| Film support |

*image dye-forming compound B - magenta dye-forming compound having the structure:

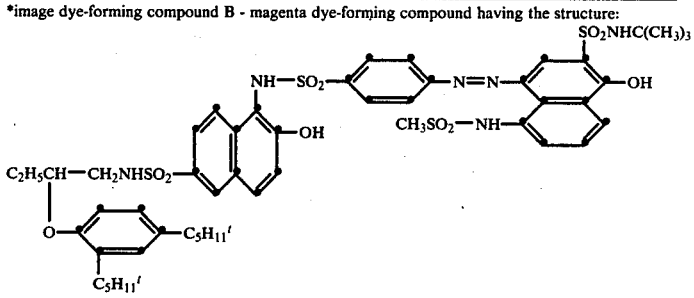

Four samples of the element were sensitometrically exposed and subjected to the following processing sequence, at 100° F. (38° C.), which varied in the development step in terms of pH and solution composition as set forth below:

| Processing Sequence | |
|---|---|
| develop** | 1 min. |
| wash | 1 min. |
| bleach-fix | 2 min. |
| wash | 2 min. |
| buffer at pH 7 | 1 min. |

**Composition of developer solutions:

| | Solution A | Solution B | Solution C | Solution D |
|---|---|---|---|---|
| NaOH | 20.0 | 20.0 | 2.2 | 2.2 |
| $Na_3PO_4$ | — | — | 38.8 | 38.8 |
| $Na_2SO_3$ | — | — | 4.85 | 4.85 |
| KBr | 10.0 | 10.0 | 10.0 | 10.0 |
| 5-methylbenzotriazole | 0.1 | 0.1 | 0.1 | 0.1 |
| 4 hydroxy methyl-4-methyl-1-phenyl-3-pyrazolidone (HMPP) | 0.3 | 0.3 | 0.3 | 0.3 |
| 11-aminoundecanoic acid (11-AUA) | — | 2.0 | — | 2.0 |
| water to | 1 liter | 1 liter | 1 liter | 1 liter |
| pH | 13.7 | 13.7 | 11.5 | 11.5 |

After processing, positive magenta dye images were observed in all of the samples; however, at pH 11.5 the sample which was processed with 11-AUA had a lower minimum dye density and less yellow stain than did the control sample at pH 11.5. Additionally, higher maximum dye densities were observed at both pH's when 11-AUA was present in the developer solution. (See the table below.)

| Process | pH | AUA (g./l.) | Blue Dmin | Green Dmin | Green Dmax | Ag° Emax |
|---|---|---|---|---|---|---|
| Developer A | 13.7 | 0 | 0.17 | 0.18 | 1.63 | 67 |
| Developer B | 13.7 | 2 | 0.19 | 0.19 | 1.97 | 61 |
| Developer C | 11.5 | 0 | 0.36 | 0.80 | 2.60 | 52 |
| Developer D | 11.5 | 2 | 0.24 | 0.22 | 2.90 | 57 |

Although the invention has been described in considerable detail with particular reference to certain preferred embodiments thereof, variations and modifications can be effected within the spirit and scope of the invention.

We claim:

1. An alkaline processing composition comprising an amino acid selected from the group consisting of 6-aminohexanoic acid and 11-aminoundecanoic acid.

2. An alkaline processing solution comprising a mixture of n-butylamine and butyric acid.

3. The alkaline processing composition of claim 1 or 2 wherein the concentration of the amino acid or said mixture is from 0.1 g/l. to 60 g/l.

4. The alkaline processing composition of claim 3 wherein the concentration of the amino acid or said mixture is from 1 g/l. to 20 g./l.

5. The alkaline processing composition of claim 1 or 2 additionally comprising a silver halide developer.

6. The alkaline processing composition of claim 5 wherein the silver halide developer is a 3-pyrazolidone.

* * * * *